United States Patent [19]

Schmid

[11] Patent Number: 4,895,511

[45] Date of Patent: Jan. 23, 1990

[54] COLOR OR SCENT MODIFIED FLAME POCKET LIGHTERS

[76] Inventor: Ronald W. Schmid, S. 29th St., Virginia Park #96, Ft. Pierce, Fla. 33450

[21] Appl. No.: 261,121

[22] Filed: Oct. 24, 1988

[51] Int. Cl.[4] ..... F23Q 2/32

[52] U.S. Cl. ..... 431/126; 431/4; 431/258; 431/277; 422/126

[58] Field of Search ..... 431/4, 129, 130, 142, 431/145, 253, 254, 277, 126, 258; 222/94, 136; 422/123, 125, 126; 126/350 B

[56] References Cited

U.S. PATENT DOCUMENTS

| | | | |
|---|---|---|---|
| 2,270,443 | 1/1942 | Jares | 431/126 |
| 2,510,449 | 6/1950 | Williams et al. | 422/125 |
| 2,941,696 | 6/1960 | Homm | 222/136 |
| 3,355,913 | 12/1967 | Frangos | 422/125 |
| 3,416,709 | 12/1968 | Shultz et al. | 222/94 |
| 3,468,615 | 9/1969 | Carey | 431/126 |
| 3,700,378 | 10/1972 | Scheid | 431/4 |
| 4,583,939 | 4/1986 | Brickwedde | 431/253 |

*Primary Examiner*—Carl D. Price

*Attorney, Agent, or Firm*—Carroll F. Palmer

[57] ABSTRACT

A pocket lighter capable of providing a vividly colored or scent modified flame basically includes a fluid containment portion, a fuel combustion portion, a valve unit and an igniter. The fluid containment portion has a first compartment containing pressurized fuel, a second compartment containing flame colorant or scenting liquid, and lines for conducting fuel from the first compartment to the fuel combustion portion and for conducting modification liquid from the second compartment to the fuel combustion portion via the valve unit. In preferred embodiments, the second compartment is a flexible bag enveloped by the first compartment and immersed in the pressurized fuel.

6 Claims, 1 Drawing Sheet

COLOR OR SCENT MODIFIED FLAME POCKET LIGHTERS

FIELD OF THE INVENTION

This application relates to pocket lighters, i.e., so-called cigarette lighters. More particularly, it concerns such lighters that emit red, green or other vividly colored flames visible even in broad daylight and/or whose flames emit a scent.

BACKGROUND OF THE INVENTION

The coloration of flames has been known for centuries. Typically, this is attained by the injection of color producing agents in some manner into the flame or incorporation of such agents in the fuel that produces the flame. Metallic salts have historically been used as flame coloration agents with the particular color generated being dependent primarily on the metal content of the salt. This chemical phenomenon has been used for ages in fireworks and, more recently, in color producing fireplace logs and kindling.

Also recently, the concept of adding color to flames generated by portable combustion devices, e.g. a pocket lighter for cigarettes, has been disclosed in U.S. Pat. No. 3,468,615.

OBJECTS

A principal object of this invention is the provision of new, novel forms of pocket lighters.

Further objects include the provision of:

1. Improved forms of pocket lighters capable of producing colored flames having a color intensity appreciably greater than could be obtained in such devices heretofore.
2. Pocket lighters capable of generating scent modified flames.
3. Such pocket lighter that include flexible bag means for containment of flame modification liquid that utilizes the pressure of the lighter fuel to charge the modification liquid into the lighter flame.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of pocket lighters capable of providing a colored flame visible in daylight.

The new lighters basically comprise a fluid containment portion, a fuel combustion portion, valve means and igniter means.

The fluid containment portion comprises a first compartment containing pressurized fuel, a second compartment containing flame modification liquid, preferably in the form of a flexible bag enveloped by the first compartment and immersed in the pressurized fuel. There is a first tubular member for conducting fuel from the first compartment to the fuel combustion portion via the valve means, and a second tubular member for conducting modification liquid from the second compartment to the fuel combustion portion via the valve means.

The fuel combustion portion comprises a burner unit connected to the first tubular member which includes a heat resistant fibre bundle though which the fuel passes on its way to combustion. Also, a tubular heat reflector surrounds the burner unit, a nozzle is connected to the second tubular member positioned to dispense modification liquid into flame emitted by the burner unit, and a heat activated valve is associated with the nozzle to control the dispensing of modification liquid therefrom.

The valve means comprises a first valve that controls flow of fuel through the first tubular member and a second valve that controls flow of liquid through the second tubular member. The first and second valves are arranged to simultaneously open and close.

The igniter means is positioned in the fuel combustion portion to ignite fuel delivered to the burner unit upon the opening of the first valve. This unit may be, for example, a flint and striker wheel or an electronic igniter.

BRIEF DESCRIPTION OF THE DRAWINGS

A more complete understanding of the invention may be had by reference to the accompanying drawings in which.

DESCRIPTION OF THE PREFERRED EMBODIMENTS

Figure 1:
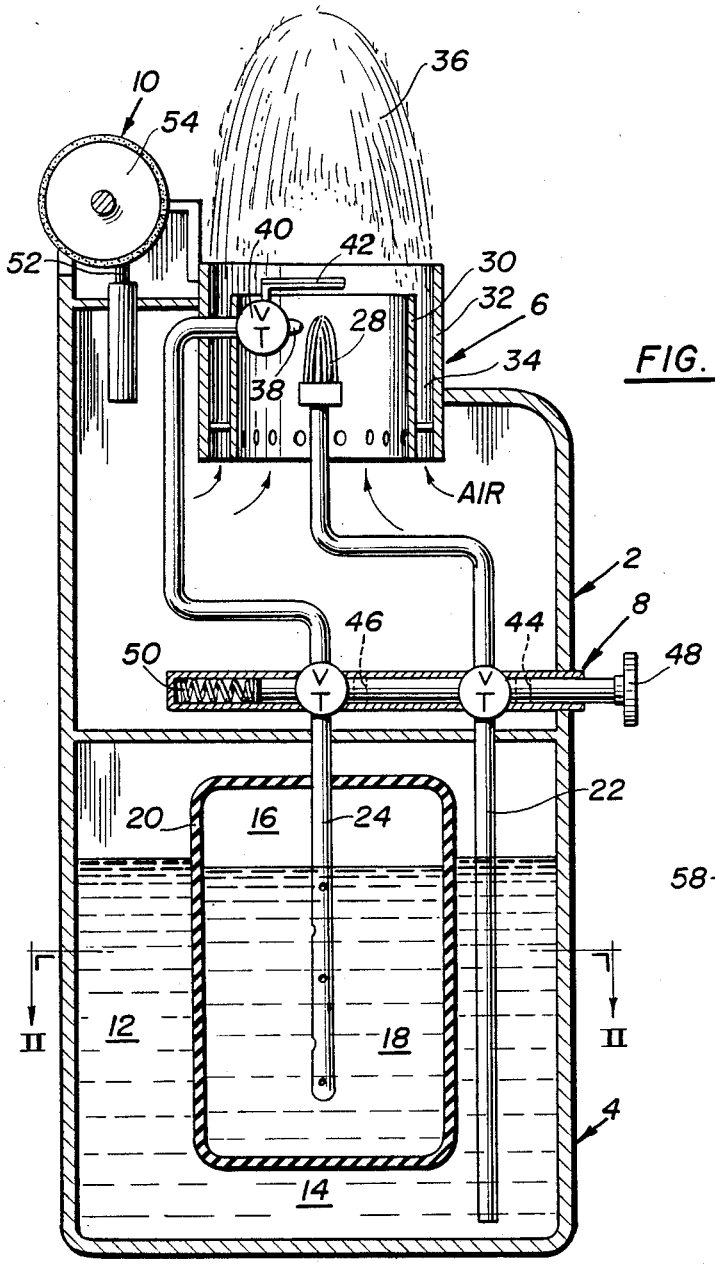
FIG. 1 is a lateral sectional view of a first embodiment of a pocket lighter of the invention.

Referring in detail to the drawings, wherein identical components are identically numbered, the pocket lighter 2 comprises a fluid containment portion 4, a fuel combustion portion 6, valve means 8 and igniter means 10.

The fluid containment portion includes a first compartment 12 containing pressurized fuel 14, a second compartment 16 containing flame coloration liquid 18 in the form of a flexible bag 20 enveloped by the first compartment and immersed in the pressurized fuel 14. Compartment 12 can be made of metal or plastic and bag 20 can be made of neoprene or other flexible material that is inert toward butane or whatever other fuel 14 is contained in compartment 12.

In a preferred embodiment, compartment 12 is made of clear plastic and some indicia, e.g., an advertisement, is carried on the side **20*a* of the bag 20 to be viewed through the side 21 of compartment 12. The bag 20 will typically take up approximately 40% of the volume of compartment 12**.

There is a first tubular member 22 for conducting fuel 14 from the first compartment 12 to the fuel combustion portion 6 via the valve means 8, and a second tubular member 24 for conducting coloration liquid 18 from the second compartment 16 to the fuel combustion portion 6 via the valve means 8.

The fuel combustion portion 6 comprises a burner unit 26 connected to the first tubular member 22 that includes a heat resistant fiber bundle 28 through which the fuel 14 passes on its way to combustion. A tubular heat reflector 30 surrounds the burner unit 26 and a tubular housing 32, in turn, surrounds reflector 30. As shown, there is a annular space 34 between reflector 30 and housing 32 through which air can pass (as indicated by the arrows in FIG. 1) to mix with the flame 36.

The fiber bundle 28, that typically consists of a loose bundle of glass, metal or ceramic fibers that taper upwardly from the burner 26 and form an extension thereof, acts as a "gas wick". Also, fiber bundle 28 prevents having open burner nozzles that could become clogged with deposits from the colorant liquid 18 and is self-cleaning when deposits of combustion products due occur. Metallic, e.g., catalytic, coatings may be applied to the fibers of bundle 28.

The reflector 30 typically consists of a section of metal tubing open at the top and bottom. The purpose of the reflector 30 is to reflect heat from the flame 36 and create a more volatile combustion atmosphere for the colorant liquid 18. The combination of the reflector 30 with the fiber bundle 28 also makes it difficult to blow out the flame 36. This makes the new lighters 2 particularly useful on boats, outdoors or in other windy environments.

The housing 32 surrounds the reflector 30 and protects the user of the lighter 2 from the heat of the flame 36, yet allows air to flow in space 34. This air flow serves the dual function of cooling the reflector 30 and stabilizing the flame 36 that emits from the top of reflector 30.

The second tubular member 24 terminates with a nozzle 38 positioned to dispense coloration liquid 18 into the flame 36 and a heat activated valve 40 is associated with the nozzle 38 to control the dispensing of coloration liquid therefrom. A part of the valve 40 is a metal rod 42 that expands when heated by the flame 36 to open the valve 40 to permit liquid 18 to issue from nozzle 38.

The purpose of the control valve 40 is to seal the nozzle 38 until heat from the flame 36 heats the rod 42 to a temperature at which valve 40 opens. This prevents colorant liquid 18 from being injected into the combustion unit 6 until flame 36 has become stabilized and is hot enough to properly interact with the colorant liquid 18. Further, valve 40 prevents liquid 18 from leaving nozzle 38 should fuel leaving burner 26 fail to ignite for some reason or be extinguished. Emission of liquid 18 from nozzle 38 in the absence of a hot, stabilized flame 36 must be avoided to prevent colorant salts from crystallizing on the fibre bundle 28 and/or the nozzle 38 since this can prevent proper functioning of the lighters.

The valve 40 may take a variety of specific forms and may include bimetal expansion elements.

The valve means 8 comprises a first valve 44 that controls flow of fuel 14 through the first tubular member 22 and a second valve 46 that controls flow of liquid 18 through the second tubular member 24. The first and second valves 44 and 46 are bores in a pushrod 48 biased by the coil spring 50 toward the valve closing position as shown. With this arrangement, valves 44 and 46 simultaneously open and close. Other forms of mechanical synchrone bivalves are known and may be used in place of the bivalves 44 and 46.

The igniter means 10 is positioned in the fuel combustion portion 6 to ignite fuel delivered to the burner unit 26 upon the opening of the first valve 44. In the embodiment of FIG. 1, the igniter means 10 comprises a flint 52 and striker wheel 54, but other type igniters may be employed, e.g., an electronic igniter (not shown). The igniters may be connected with the valve means 8 so that when the bivalves are opened, the igniter will be actuated.

Figure 3:
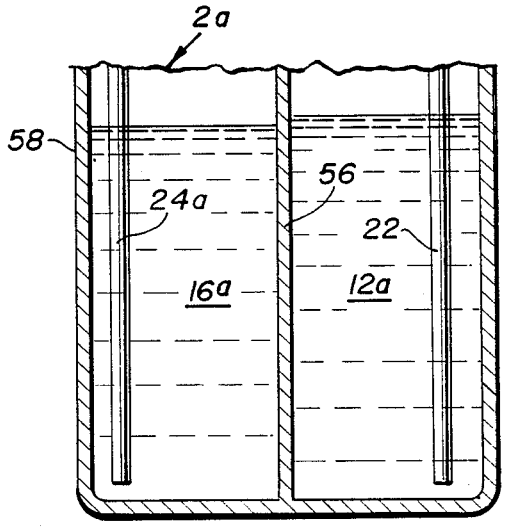
FIG. 3 is a fragmentary, lateral sectional view of the fuel containment compartment of a second embodiment of a pocket lighter of the invention.
Figure 2:
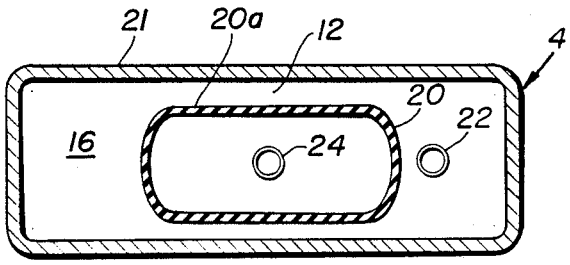
FIG. 2 is a sectional view taken on the line II—II of FIG. 1.

In the second embodiment of a pocket lighter 2*a* (see FIG. 3), the fuel compartment 12*a* is separated from the colorant liquid compartment 16*a* by an inflexible wall 56 in the container 58. In this form of lighter 2*a*, the pressure of the fuel in compartment 12*a* will not function to force colorant liquid out the second tubular member 24*a* so some pressurizing material, e.g., nitrogen gas, is contained in the compartment 16*a* for this purpose.

In the new lighters 2, the colorant liquid 18 carried in bag 20 is pressurized by the butane fuel contained in compartment 12. Hence, with rod 48 is pushed to open valves 44 and 46, both fuel 14 and liquid 18 will flow in the respective lines 22 and 24. Butane fuel 14 passes into the fiber bundle 28 to be ignited by igniter 10. Air passing up inside reflector 30 mixes with the fuel 14, thus promoting its combustion. The reflector 30 also raises the temperature level of flame 36 and creates the maximum temperature in the region of the tip of bundle 28 where the nozzle 38 injects the colorant liquid 18 to mitigate salt crystal formation and insuring the most vivid possible color display in the flame 36.

As the flame ignition occurs, the colorant liquid 18 feeds through line 24 to the nozzle 38, but will not immediately exit due to valve 40. Within a short time, e.g., a second, fiber bundle 28 heats up, and, in turn, so does rod 42 thereby opening valve 40 to deliver liquid 18 from nozzle onto the bundle 28. As a result, the liquid 18 also ignites creating vivid coloration of the flame 36.

In the lighters 2, once the pressurized fuel 14 is used up there is no pressure to force liquid 18 in line 24. However, the volumes of fuel 14 and liquid 18 are computed so that fuel 14 will be exhausted while bag 20 still contains about 2–5% liquid 18. Thus, throughout its life it will continue to operate as a colored flame lighter.

In other embodiments of the new lighters 2 and 2*a*, the modification liquid 18 instead of or in addition to containing flame colorant material may contain perfume or other scent substances. Since scent substances do not require the high temperatures needed to effectively use the flame colorants, the two chamber system of the invention may be used without the fiber bundle 28 and the control valve 40. Also, while perfumes and colognes are preferred scent substances, other aromatic liquids may be used. Advantageously, the scent substance can be tied in the an advertisement displayed on the side 20*a* of the bag 20 as previously described.

Butane is a preferred material for use as the fuel 14 in the new lighters 2 and 2*a*. It should be relatively pure, e.g., free of sodium which would create a yellow flame and distort the intended color. Other fuels may be substituted by those skilled in the art.

Colorant liquid 18 must contain a chemical that upon combustion in the flame 36 will produce a colored flame. Metallic salts are preferred as colorants and the liquid should be flamable. However, all flamable liquids are not suitable, even though they will dissolve the colorant, because they can produce toxic combustion products. Alcohols are preferred because they easily dissolve metallic salts and undergo total combustion, producing only carbon dioxide and water. Methyl, ethyl and isopropyl alcohols are recommended.

Preferred metal cations for metal salt flame colorant include sodium for yellow; calcium, yellow reddish; barium, yellow-green; potassium, violet; rubidium, violet; lithium, reddish; strontium; reddish; boron, green; italium, green; copper, green or blue; indium, blue or purple depending on chloride or chlorate anion. Mixtures of one or more of these can be used to produce stronger colors.

The colorant should not produce toxic combustion products either of itself or its effect on the combustion of the fuel. Strontium chloride, boric acid calcium salts, sodium salts and potassium salts pose no health hazards and are preferred.

Esters may also be used as flame colorants in the invention, e.g., boron tri-methyl ester produces a vivid green flame. Also, since it is an ester, its combustion products produces a pleasant scent. Similarly, other non-toxic esters may be used to give a variety of colors as well as pleasant scent. Since the esters are combustible organic compounds, they need not be dissolved in a solvent, but can be dissolved in a solvent, e.g., methyl alcohol, if desired.

The embodiments of the invention in which an exclusive property or privilege is claimed are defined as follows:

1. A pocket lighter capable of providing a colored flame visible in daylight which comprises:

a fluid containment portion, a fuel combustion portion, valve means and igniter means, said fluid containment portion comprising:

a first compartment containing pressurized fuel, a second compartment containing flame coloration liquid, a first tubular member for conducting fuel from said first compartment to said fuel combustion portion via said valve means, a second tubular member for conducting coloration liquid from said second compartment to said fuel combustion portion via said valve means, said fuel combustion portion comprising:

a burner unit connected to said first tubular member, a nozzle connected to said second tubular member positioned to dispense coloration liquid into a flame emitted by said burner unit, a heat activated valve associated with said nozzle to control the dispensing of said coloration liquid therefrom, said valve means comprising:

a first valve that controls flow of fuel through said first tubular member and a second valve that controls flow of liquid through said second tubular member, said first and second valves being arranged to simultaneously open and close, said igniter means being positioned in said fuel combustion portion to ignite fuel delivered to said burner unit upon the opening of said first valve.

2. A pocket lighter capable of providing a colored flame visible in daylight which comprises:

a fluid containment portion, a fuel combustion portion, valve means and igniter means, said fluid containment portion comprising:

a first compartment containing pressurized fuel, a second compartment containing flame coloration liquid in the form of a flexible bag enveloped by said first compartment and immersed in said pressurized fuel, a first tubular member for conducting fuel from said first compartment to said fuel combustion portion via said valve means, and a second tubular member for conducting coloration liquid from said second compartment to said fuel combustion portion via said valve means, said fuel combustion portion comprising:

a burner unit connected to said first tubular member, said burner unit including a heat resistant fibre bundle though which said fuel passes on its way to combustion, a tubular heat reflector surrounding said burner unit, a nozzle connected to said second tubular member positioned to dispense coloration liquid into a flame emitted by said burner unit, and a heat activated valve associated with said nozzle to control the dispensing of said coloration liquid therefrom, said valve means comprising:

a first valve that controls flow of fuel through said first tubular member and a second valve that controls flow of liquid through said second tubular member, said first and second valves being arranged to simultaneously open and close, said igniter means being positioned in said fuel combustion portion to ignite fuel delivered to said burner unit upon the opening of said first valve.

3. A pocket lighter of claim 2 having a tubular housing surrounding said tubular heat reflector providing an annular passageway around said reflector though which air may rise to mix with the flame created by said burner unit.

4. A pocket lighter capable of providing a color or scent modified flame which comprises:

a fluid containment portion a fuel combustion portion, valve means and igniter means, said fluid containment portion comprising:

a first compartment containing pressurized fuel, a second compartment containing flame modification liquid, a first tubular member for conducting fuel from said first compartment to said fuel combustion portion via said valve means, a second tubular member for conducting modification liquid from said second compartment to said fuel combustion portion via said valve means, said fuel combustion portion comprising:

a burner unit connected to said first tubular member, a nozzle connected to said second tubular member positioned to dispense modification liquid into a flame emitted by said burner unit, a heat activated valve associated with said nozzle to control the dispensing of said flame modification liquid therefrom, said valve means comprising:

a first valve that controls flow of fuel through said first tubular member and a second valve that controls flow of liquid through said second tubular member, said first and second valves being arranged to simultaneously open and close, said igniter means being positioned in said fuel combustion portion to ignite fuel delivered to said burner unit upon the opening of said first valve.

5. The pocket lighter of claim 4 wherein said second compartment is a flexible bag enveloped by said first compartment and immersed in said pressurized fuel.

6. The pocket lighter of claim 4 wherein said igniter unit comprises a flint and striker wheel.

* * * * *